US005235731A

United States Patent [19]

Anzai et al.

[11] Patent Number: 5,235,731

[45] Date of Patent: Aug. 17, 1993

[54] MOLDED-RESIN SEPARABLE FASTENER AND FASTENING SYSTEM UTILIZING THE SAME

[75] Inventors: Seio Anzai; Kunihiko Shimamura, both of Okayama; Tadanori Kunikawa, Yao, all of Japan

[73] Assignee: Kuraray Co., Ltd., Kurashiki, Japan

[21] Appl. No.: 858,023

[22] Filed: Mar. 26, 1992

[51] Int. Cl.[5] ..... B65D 33/00

[52] U.S. Cl. ..... 24/576; 24/577; 24/587; 383/63

[58] Field of Search ..... 24/576, 577, 587, 399, 24/400, 306, 450, 452; 383/63

[56] References Cited

U.S. PATENT DOCUMENTS

| | | | |
|---|---|---|---|
| 3,338,285 | 8/1967 | Jaster | 24/587 |
| 3,495,306 | 2/1970 | Eichberg | 24/576 |
| 3,808,649 | 5/1974 | Ausnit | 383/63 |
| 4,736,496 | 4/1988 | Fisher et al. | 383/63 |
| 4,792,240 | 12/1988 | Ausnit | 383/63 |
| 4,858,286 | 8/1989 | Siegel | 24/576 |
| 5,077,870 | 1/1992 | Melbye et al. | 24/452 |

FOREIGN PATENT DOCUMENTS

| | | | |
|---|---|---|---|
| 0760697 | 11/1956 | United Kingdom | 24/577 |

*Primary Examiner*—Victor N. Sakran

*Attorney, Agent, or Firm*—Oblon, Spivak, McClelland, Maier & Neustadt

[57] ABSTRACT

A molded-resin separable fastener comprising a substrate and, provided vertically on at least one surface thereof, a plurality of straight wall-like fastening elements arranged parallel with each other at regular intervals and with an umbrella-like or hook-like cross-sectional shape, the configurational parameters of which are specified such that when 2 sheets of the molded-resin separable fasteners are faced and engaged with each other the fasteners are relatively slidable in the longitudinal direction and slightly movable in the transverse direction.

8 Claims, 9 Drawing Sheets

MOLDED-RESIN SEPARABLE FASTENER AND FASTENING SYSTEM UTILIZING THE SAME

BACKGROUND OF THE INVENTION

1. Field of the Invention

The present invention relates to a molded-resin separable fastener (hereinafter referred to as "molded separable fastener") and a fastening system utilizing such molded separable fastener. More specifically, the present invention relates to a molded separable fastener, a pair of which and having the same shape can be integrally engaged with each other into an entity, in the entity one, of the pair being a little movable relative to the position of the other one of the pair in the direction of engagement (hereinafter referred to as "transverse direction") and, at the same time, slidable in the direction of the length of the fastening elements ("hereinafter referred to as longitudinal direction").

2. Description of Prior Art

Conventional separable fasteners sold under the commercial names of "MAGIC TAPE®" and "MAGI-TOUCH®", consist of a male fastener component comprising a substrate and, provided vertically on one surface thereof, a multiplicity of hook-like fastening elements comprising a hooked synthetic monofilament or a shaped resin with swollen head and a female component comprising a substrate and provided vertically on one surface thereof, a multiplicity of loop-like fastening elements, the male and female components being adherable to each other by engagement of the two fastening elements.

Separable fasteners sold under the commercial name of "SCOTCH MATE®" or "DUAL LOCK®" employ a different engaging system from the above and consist of a pair of the same fastener components comprising a substrate and, provided on one surface thereof in lines, a multiplicity of projections with swollen heads, the two components being adherable to each other by facing them to each other and then inserting the lines of the projections with the swollen head of one of the pair into clearances between the lines of the projections with the swollen head of the other of the pair.

The above two fastening systems both comprises adhering 2 separable fastener components to each other by realization of a multiplicity of dot-wise engagements distributed on a plane and allows only little relative movement after adhesion has once been effected.

The above conventional separable fasteners all have the object of firmly adhering and consolidating the 2 components. Consequently, it is difficult, after the 2 components have been closely adhered to each other, to shift either one of the 2 components for the purpose of adjusting the position. Forced shifting of one of the 2 components already consolidated will cause, due to a large shearing force occurring on the engaged surface, the fastener components to be separated or the fastening elements to break. When one wants to adjust the position of a counterpart, relative to its fellow's position, of the 2 components of conventional separable fasteners and already closely engaged with each other, it is necessary to first disengage the 2 components, then move one of them to the desired position and engage them with each other again. Application of such conventional separable fasteners is therefore fundamentally not suited to the uses that require fine adjustment of the position.

SUMMARY OF THE INVENTION

Accordingly, an object of the present invention is to provide a molded-resin separable fastener without the above problems and an engaging system utilizing it.

Another object of the present invention is to provide a position-adjustable molded separable fastener, 2 sheets of which can be integrally engaged with each other into an entity, in the entity one of the 2 sheets being a little movable relative to the position of the other of the two sheets in the transverse direction and freely slidable in the longitudinal direction, and an engaging system utilizing the separable faster.

Still another object of the present invention is to provide a molded-resin separable fastener that can readily be produced by extrusion molding or injection molding, and an engaging system utilizing the separable faster.

All the above objects can be achieved by providing a molded separable fastener according to the present invention which is produced by a markedly simple process and at a markedly reduced cost. The molded container of the present invention and the engaging system utilizing it can be widely used in various fields that require fine adjustment of the mounted position, such as mounting of interior or exterior finishing materials and mounting of seat cover in cars, airplanes and the like.

Thus, the present invention provides a molded-resin separable fastener comprising a substrate and, provided vertically on at least one surface thereof, a plurality of straight wall-like fastening elements arranged parallel with each other at regular intervals and with an umbrella-like cross-sectional shape having a pair of projections extending from the top part towards both sides and downwardly; in the cross-sectional shape thereof, the height (H) of the top (Y) of the hook based on the substrate surface line being in a range of 1.5 to 5 mm, the hook width (B) defined by the distance between the outermost ends of said pair of projections being in a range of 1.5 to 5 mm and the relationship between the height (A) of the top of the hook based on a straight line (L) parallel with the substrate surface line and tangent to the lowest end of said projection, the height (E) of said straight line (L) based on the substrate surface line and the distance (D/2) between a point (X) where said straight line (L) crosses a straight line perpendicular thereto and tangent to the outermost end of said projection and a point (V) where said line (L) crosses nearer one of the 2 lines defining the trunk part, the relationship between said hook width (B) and the distance (S) between the outermost end of the projection and the outermost end of nearer one of the pair of the projections of adjacent fastening element and the relationship between the above distance (D/2) and the distance between corresponding points on two adjacent ones of said fastening elements, i.e. (B+S), satisfying the following conditions $$A \leqq E \leqq A + 1.2D \quad (1)$$

$$0.7B \leqq S \leqq 1.2B \quad (2)$$

$$0.15(B+S) \leqq D \leqq 0.45(B+S). \quad (3)$$

The present invention further provides a molded-resin separable fastener comprising a substrate and, provided on at least one surface thereof, a plurality of straight wall-like fastening elements arranged parallel to each other at regular intervals and with a hook-like cross-sectional shape in which a trunk part at first projects upwardly from the substrate line, then curves aslant as it nears the top and bends at the top downwardly, said plurality of straight wall-like fastening elements all being bent at the top downwardly in the same direction; in the cross-sectional shape thereof, the height (H) of the top (Y) of the hook based on the substrate surface line being in a range of 1.5 to 5 mm, the hook width (B) defined by the distance between a point (X) where a straight line (L) crosses a straight line perpendicular thereto and tangent to the outermost end of said bentdown end and a point (Z) where said straight line (L) crosses farther one of the 2 trunk-defining lines being in a range of 1.5 to 5 mm and the relationship between the height (A) of the top (Y) of the hook based on said straight line (L), the height (E) of said straight line (L) based on the substrate surface line and the distance (D) between said point (X) and a point (V) where said straight line (L) crosses nearer one of the 2 lines defining the upwardly projecting trunk part of said fastening element, the relationship between said hook width (B) and the distance (S) between the outermost end of the bent-down end and said point (Z) of adjacent fastening element and the relationship between the above distance (D) and the distance between corresponding points on two adjacent ones of said fastening elements, i.e. (B+S), satisfying the following conditions (1) through (3)

$$A \leqq E \leqq A + 1.2D \quad (1)$$

$$0.7B \leqq S \leqq 1.2B \quad (2)$$

$$0.15(B+S) \leqq D \leqq 0.45(B+S). \quad (3)$$

The present invention still further provides engaging systems utilizing the above molded-resin separable fasteners. In either of the above cases, 2 pieces of the molded-resin separable fasteners of the present invention can be engaged with each other in such a manner that one of the 2 separable fasteners can, while being integrally engaged with its fellow, be moved a little in the transverse direction and freely in the longitudinal direction. As a result the engaging system of the present invention can meet the contradictory 2 requirements of (1) 2 sheets of molded separable fasteners being readily mountable and demountable; and (2) the 2 molded separable fasteners having high engagement strength.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

Figure 1:
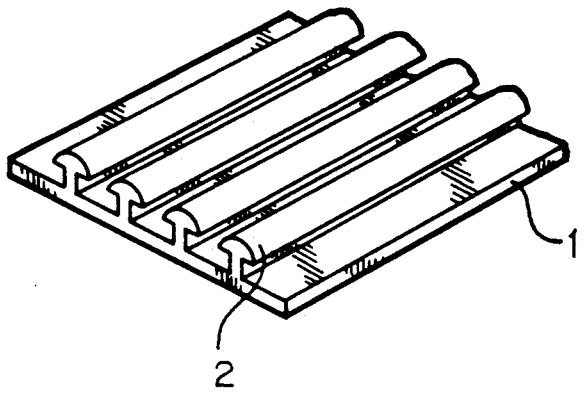
FIGS. 1 through 7 are diagrammatic perspective views showing examples of the molded separable fastener of the present invention.
Figure 2:
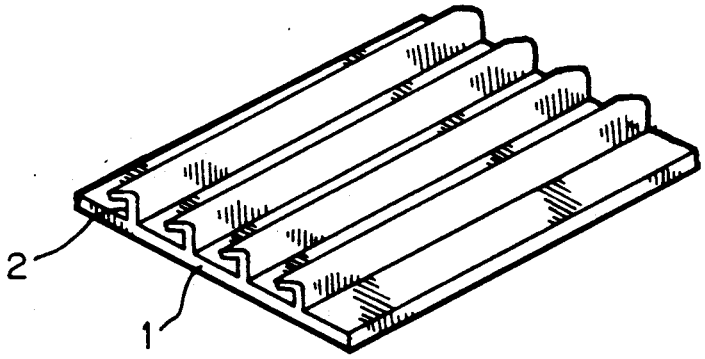

FIGS. 1 and 2 are perspective views showing the molded separable fasteners of the present invention, in which on one surface of a strip-shaped substrate 1 are vertically provided a plurality of straight wall-like fastening elements 2 arranged parallel with each other at regular intervals and having a hook-like cross-sectional shape. FIG. 1 shows a 2-sleeve type, or swollen-head type, hook-like cross-section, while FIG. 2 a single-sleeve type hook-like cross-section.

Figure 3:
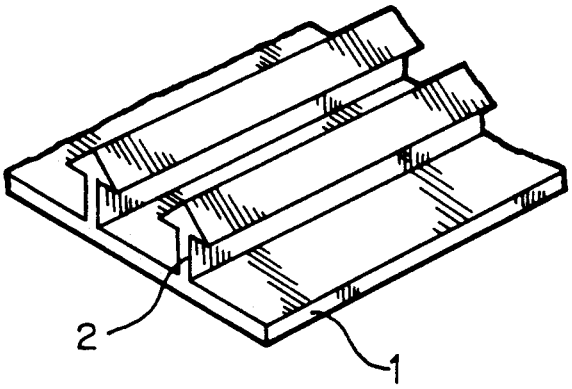
Figure 4:
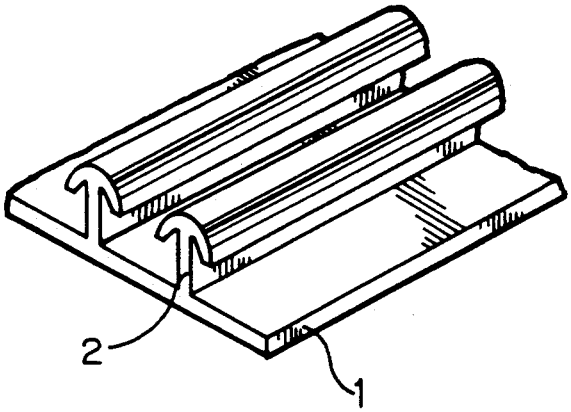
Figure 5:
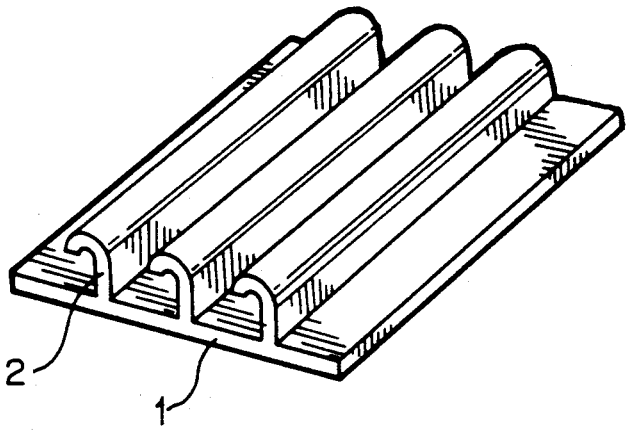
Figure 6:
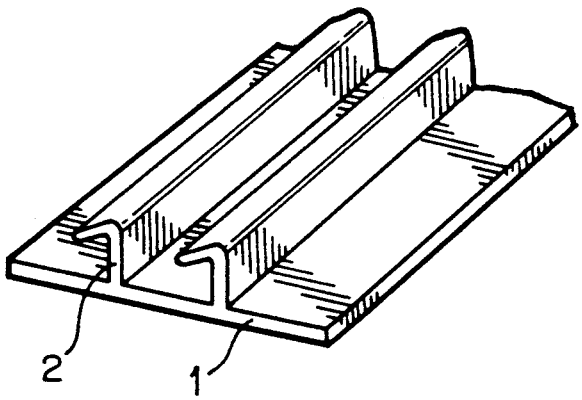
Figure 7:
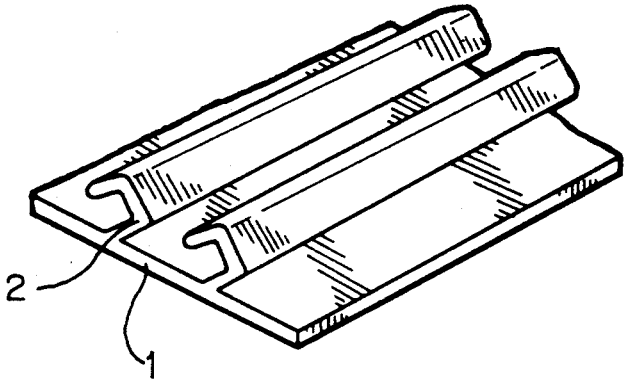

Examples of the 2-sleeve type cross-section are mushroom shape as shown in FIG. 1, arrowhead (ancient Greek) shape as shown in FIG. 3 and umbrella shape as shown in FIG. 4. The 2-sleeve, swollen-head shape may either be symmetrical or asymmetrical, but generally symmetrical shapes are employed. Examples of the single-sleeve type cross-section are, in addition to one shown in FIG. 2, nearly U-shape as shown in FIG. 5, one with inclined trunk part as shown in FIG. 6 and one having a plurality of bents as shown in FIG. 7. The cross-section of the molded separable fastener of the present invention may assume a variety of shapes other than the above-mentioned which meet the object of the present invention.

Figure 8:
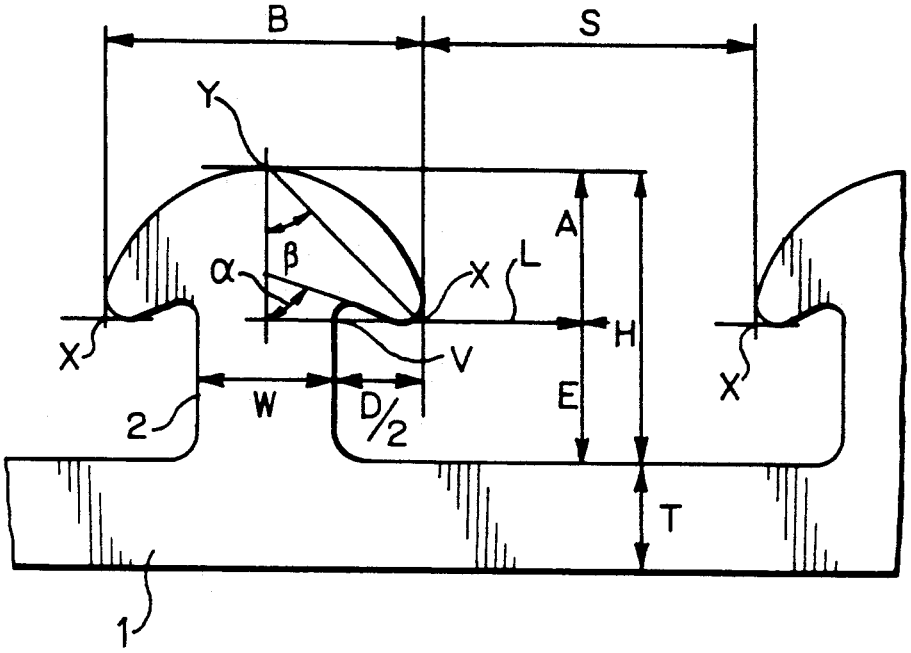
FIGS. 8 and 9 are cross-sectional views illustrating the parameters of the 2 molded separable fasteners of the present invention, respectively.
Figure 9:
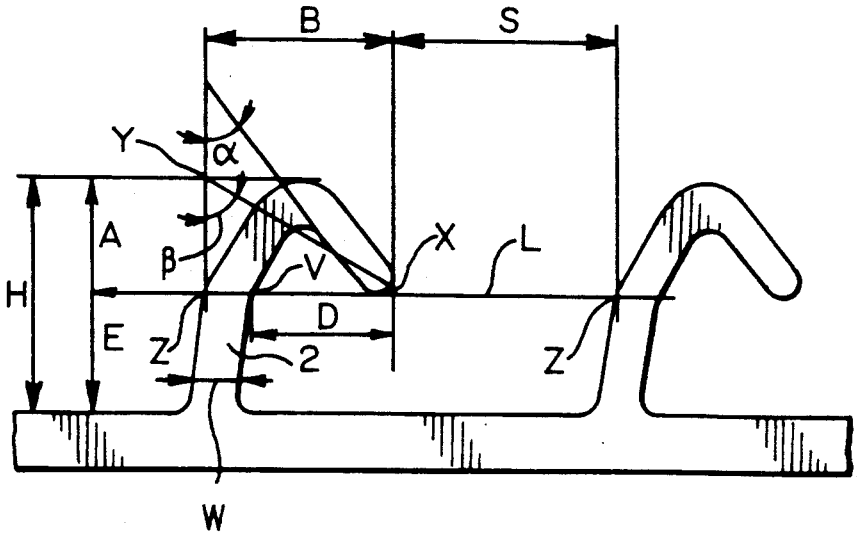

For the molded separable fastener of the present invention, it is important and necessary that, in the cross-section as shown in FIGS. 8 and 9, the structural parameters described below satisfy specific conditions. The parameters are:

a. Height (H) of the fastening element based on the substrate surface line, the height is equal to (A+E)

b. Height (A) of the top of the fastening element based on a straight line (L) parallel with the substrate surface line and tangent to the lowest end of the hook, c. Height (E) of the straight line (L) based on the substrate surface line, [hereinafter this height (E) is referred to as "the sleeve-end height" of the fastening element]

d. Hook width (B), defined by, in FIG. 8, the distance between the outermost ends of a pair of projections, or in FIG. 9, the distance between the point (X) and a point (Z) where the straight line (L) crosses farther one of the 2 lines defining the upwardly projecting trunk part;

e. Distance, (D/2) in FIG. 8 i.e. 2-sleeve type, and (D) in FIG. 9 i.e. single-sleeve type, between the point (X) and a point (V) where the line (L) crosses nearer one of the 2 vertical or nearly vertical lines defining the trunk part of the fastening element [hereinafter this distance is referred to as "engaging depth"]

f. Distance (S) between the outermost end of the projection or hook and, in FIG. 8, the outermost end of nearer one of the pair of the projections of adjacent fastening element, or, in FIG. 9 the distance between the point (X) and the point (Z) of adjacent fastening element.

The molded separable fasteners of the present invention providing an engagement state in which 2 sheets of the same separable fasteners are engaged with each other with large engaging strength and still there is secured a play in the transverse direction and one of the 2 sheets of the separable fasteners is slidable in the longitudinal direction so that adjustment of the mounting position is easy.

The relationships with respect to the above parameters (A), (B), (D), (E) and (S) are important for setting within practical ranges the minimum force (pressing force) required for pressing to engage and fix 2 sheets of the molded separable fasteners, the minimum force (disengaging force) required for separating the once-engaged and -fixed 2 sheets of the molded separable fasteners and the freedom of the 2 sheets of the molded separable fasteners.

With too large a pressing force, it becomes difficult to smoothly engage integrally 2 sheets of the molded separable fasteners and, after the engagement, to separate them again. Too high a disengaging force may break the fastening elements and, moreover, render it difficult to disengage the 2 sheets for their re-use. The pressing force and disengaging force should be appropriately designed while the hardness and flexural modulus of the resin used are taken into consideration. In general, the pressing force is preferably 0.3 to 2.0 kg/cm$^2$, more preferably 0.5 to 1.5 kg/cm$^2$ for practical purposes, and the disengaging force is preferably not more than 6 kg/cm$^2$.

For the purpose of smoothly engaging 2 sheets of the molded separable fasteners with each other and to eliminate excessive play after the engagement, it is necessary that the height (A) of the top based on a horizontal line tangent to the hook end, 2 times the engaging distance in 2-sleeve type or the engaging distance itself in single-sleeve type, (D), and the sleeve-end height (E) satisfy the condition: $A \leqq E \leqq A+1.2\ D$. If the sleeve-end height (E) is smaller than the height (A) of the top from the hook end, the 2 sheets of the molded separable fasteners can hardly be engaged with each other and, if ever engaged, position adjustment in the transverse direction will be difficult. If the sleeve-end height (E) exceeds the sum of the height (A) of the top from the hook end and 1.2 D, the 2 sheets of the molded separable fasteners will, after being engaged with each other, have too large play to be a condition of being integrally engaged. In this case the 2 sheets tend, if once engaged with each other, to disengage readily.

It is also necessary that the hook width (B) and the distance (S) between the outermost hook end and the adjacent fastening element at the level of the sleeve-end height (E) satisfy: $0.7B \leqq S \leqq 1.2B$. If the distance (S) is less than, 0.7 times the hook width (B), it will become difficult to insert the hook-like elements of a molded separable fastener into the clearances formed by adjacent fastening elements of its counterpart separable fastener and, if ever inserted, to disengage later on. On the other hand, if the distance (S) exceeds 1.2 times the hook width (B), the 2 sheets of molded separable fastener once integrally engaged with each other will sometimes readily be disengagedby slight fluctuation of load or vibration or even during engagement work.

For the purpose of achieving ready integral engagement of 2 sheets of the molded separable fasteners and assuring relative movability to some extent in the transverse direction, it is necessary that 2 times the engaging depth in 2-sleeve type or the engaging depth itself in single-sleeve type, (D), be 15 to 45% of the pitch (B+S) of the fastening elements. With a (D) of less than 15% of the pitch of the fastening elements 2 sheets of once-engaged molded separable fasteners can hardly be relatively shifted for position adjustment, while with the (D) exceeding 45% of the pitch the 2 sheets of the molded separable fasteners engaged with each other have too large a play in the transverse direction so that the engagement state is instable.

The hook-like fastening elements must be of a shape that can readily engage with the fastening elements of the counterpart fastener component and assures that the once engaged fastener components are not disengaged readily. The hook angle ($\alpha$), which is as shown and defined in FIGS. 8 and 9 is generally 20° to 85°. Further for the purpose of realizing smooth engagement of the fastening elements of 2 sheets of molded separable fasteners, it is desirable that the angle ($\beta$) formed by a straight line connecting the above-described point (X) and the point (Y) which is the top end point in 2-sleeve type or a point where a horizontal line tangent to the top crosses a vertical line passing the afore-described point (Z) in single-sleeve type with the vertical line be 30° to 70° for 2-sleeve type or 40° to 80° for single-sleeve type. If the angle is less than the above range, it will be difficult, by inserting the fastening elements into the clearances between the fastening elements of the counterpart molded separable fastener, to obtain good engagement state because too high a total height results when necessary sleeve-end height is maintained. On the other hand, if the angle exceeds the above range, the top part of the hook will near plateau and hooking angle will be too large to, if once engagement is realized, exert a sufficient engagement force. Moreover in this case, the play will be too large.

The wall thickness (W), of the body or trunk of the fastening elements provided vertically on one surface of a substrate is generally 0.3 to 3 mm. It is preferably selected from a range of 0.5 to 2.0 mm depending on the hardness and flexural modulus of the resin used. If the thickness is less than 0.3 mm, it will become difficult to obtain good shape of hook by stable molding operation and the strength of the fastening will be low. On the other hand if the thickness exceeds 3 mm, the once engaged separable fasteners often readily disengage when an external force is applied thereto. Such too large thickness also requires large space which decreases engagement efficiency. The height (H), i.e. (A+E), of the fastening elements provided vertically on the surface of a substrate is 1.5 to 5 mm. In general the height is preferably 1.8 to 4.5 mm. If the height (H) is less than 1.5 mm, it will be difficult to stably mold the hook-like fastening elements and, if ever molding is done, to engage with each other 2 sheets of the molded separable fasteners having such small fastening elements. On the other hand, if the height exceeds 5 mm, the distance between the adherend will become large and, moreover, the fastening elements will tend to deform, destroying the balance of engagement, whereby disengagement readily occurs when put under external force.

The thickness (T) of the substrate of the molded separable fastener is appropriately selected depending on the hardness and flexural modulus of the resin used. The substrate thickness is generally 0.3 to 3 mm, preferably 0.8 to 2.5 mm. With the thickness being less than 0.3 mm, the molded separable fastener may readily deform, thus being of poor handling capability. Moreover, engagement of 2 sheets of the molded separable fasteners may often be broken because of bending of the substrate. With a thickness of more than 3 mm, the manufacturing cost increases due to large consumption of resin and, besides, the processability deteriorates.

The molded separable fastener of the present invention may assume any form by itself insofar as the fastening elements have the above-described specific shape. It is however generally preferable that the separable fastener have a strip shape having a width of 10 to 50 mm. The length of the substrate strip depends on the intended use of the molded separable fastener and ranges from a small length of not more than 1 to 2 cm to a large distance of several meters. The fastening elements are vertically provided on one surface of such substrate in the longitudinal direction and parallel to each other.

The molded separable fastener of the present invention exhibits, after 2 sheets thereof have integrally been engaged with each other, a large engagement strength and has a suitable shape for, when being engaged integrally or while being engaged integrally, assuring that one of the 2 sheets is slidable relative to the position of the other. The molded separable fastener of the present invention is smoothly demountable from the counterpart fastener while exhibiting necessary engagement strength. To achieve the above features the resin used is preferably a flexible type resin having a hardness of at least 70 or a hard type resin having a flexural modulus of not more than 30,000 kg/cm$^2$. If the hardness is less than 70, the resin will be too flexible so that, when 2 sheets of the molded separable fasteners are integrally engaged with each other, it will be difficult to smoothly slide one of them relative to the position of the other and, besides, the engagement will tend to be broken. If the flexural modulus exceeds 30,000 kg/cm$^2$, the resin will be too hard, thereby inevitably suffering dimensional error of some level. Dimensional error in processing the fastening elements may sometimes create the problem of too loose engagement or, conversely, requiring a markedly large pressing force to engage 2 sheets of the molded separable fasteners.

Examples of the resin used for the molded separable fastener of the present invention and having a hardness of at least 70 and a flexural modulus of not more than 30,000 kg/cm$^2$ are thermoplastic resins, e.g. polyolefin resins such as polyethylene, polypropylene and polybutene; acrylic resins such as polymethacylic acid and polyacrylonitrile; vinyl acetate- or vinyl alcohol-based resins such as polyvinyl acetate, polyvinyl alcohol and ethylene-vinyl alcohol copolymer; halogen-containing resins such as polyvinyl chloride, polyvinylidene chloride and fluoro resins; styrol resins such as polystyrene, acrylonitrile-butadiene-styrene copolymers, acrylonitrile-styrene copolymers and styrene-butadiene copolymers; diene-rubbers such as butadiene rubber, isoprene rubber and chloroprene rubber; olefin rubbers such as polyisobutylene and ethylene-propylene copolymers and polyurethane resins.

The above resins are, while satisfying the above hardness conditions, used singly or in combination. The resin used may incorporate additives including inorganic substances to modify its properties or processability. In general, resins having a hardness of at least 80 and a flexural modulus of not more than 28,000 kg/cm$_2$ and principally comprising a saturated polyester resin, polyvinyl chloride resin, polyolefin resin or polyurethane resin are preferably used. Among these resins, those principally comprising polyvinyl chloride are particularly preferred because they have excellent moldability, weather resistance and like properties and are inexpensive.

The hardness herein is the value measured with hardness tester A according to JIS K6301.

Figure 10A:
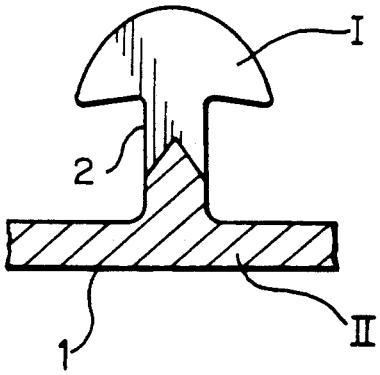
FIGS. 10A and 10B are cross-sectional views showing examples of the molded separable fastener of the present invention.
Figure 10B:
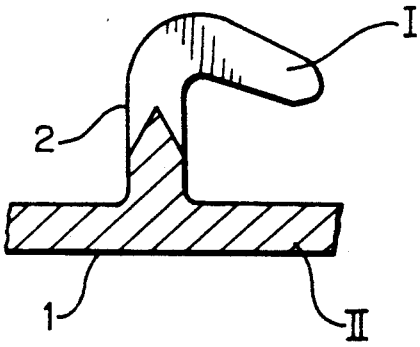

The molded separable fastener of the present invention may be molded using one or at least 2 types of the above thermoplastic resins, but it may also be, as shown in FIG. 10, produced by using 2 types of resins having different flexural moduli, i.e. resin (I) for substrate and resin (II) for fastening elements and compositing the fastening elements. This type of compositing the fastening elements can provide the resulting molded separable fastener with functions meeting the intended use of the fastener, such as increase in the substrate strength with simultaneous softening of the fastening elements which improves mountability and demountability of the separable fastener. For instance, where a resin having a flexural modulus of 23,000 kg/cm$^2$ is used as the resin (I) for substrate and one having a flexural modulus of 3,000 kg/cm$^2$ is used as the resin (II) for fastening element, the obtained separable fastener not only has a large substrate strength but also exhibit improved engagement capability that realizes soft engagement, as well as improved resistance to flexural fatigue.

Figure 11:
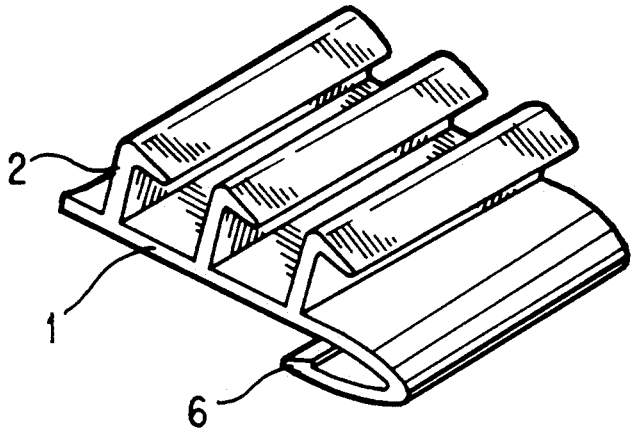
FIGS. 11 and 12 are diagrammatic perspective views showing examples of the molded separable fasteners of the present invention further provided with engaging means.
Figure 12:
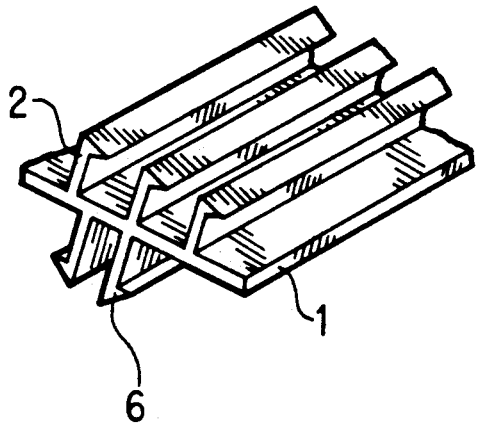
Figure 13:
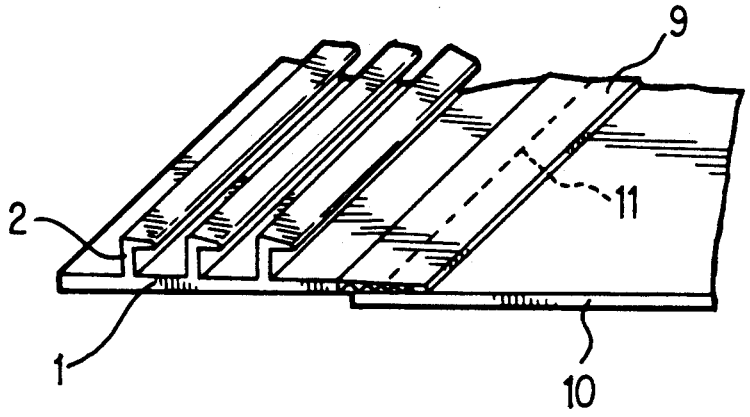
FIG. 13 is a diagrammatic perspective view showing that a molded separable fastener according to the present invention is provided integrally with a strip for mounting an adherend.

The molded separable fastener can directly be mounted on an adherend by sewing, adhesion, tacking or like means. It is also possible to provide, as shown in FIG. 11, a hook-like fixing means 6 integrally on part of the substrate, or to provide hook-like fixing means 6 vertically on the rear surface of the substrate as shown in FIG. 12. Provision of such fixing means 6 realizes ready mounting of the molded separable fastener on an adherend. Where the molded separable fastener is adhered to the surface of an adherend, an adhesive may be applied to the rear surface, i.e. surface to be adhered of the substrate. In this case it is necessary to cover with a release paper.

Where a fabric for tent or the like is to be mounted on the molded separable fastener by sewing, the fastener may as shown in FIG. 13 be provided on its one side edge integrally with a strip 9 having a width of 3 to 25 mm for mounting an adherend. The adherend-mounting strip 9 utilizes a relatively soft resin so that it is readily attached to a sheet 10 or the like by sewing and it will not be torn at the seam 11. For this purpose resins having a hardness of at least 60 and a flexural modulus of not more than 6,000 kg/cm$^2$ are generally used and they are preferabably of the same type as those used for the molded separable fastener.

Figure 14:
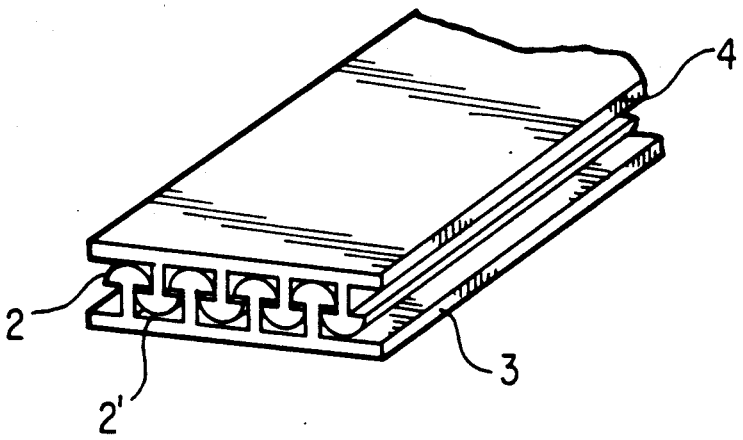
FIG. 14 is a diagrammatic perspective view showing an engaging system utilizing the two-sleeve type molded separable fastener of the present invention.

The engaging system utilizing the molded separable fastener of the present invention is next described with reference to FIGS. 14 and 15. FIG. 14 shows an example of the engaging system utilizing a molded separable fastener provided thereon with a plurality of 2-sleeve type fastening elements 2 as shown in FIG. 1. Here the fastening elements 2 of a first molded separable fastener 3 are engaged with the fastening elements 2' of a second molded separable fastener and having the same shape as that of the fastening elements 2, thereby integrally engaging the 2 sheets of the molded separable fastener with each other.

Figure 15:
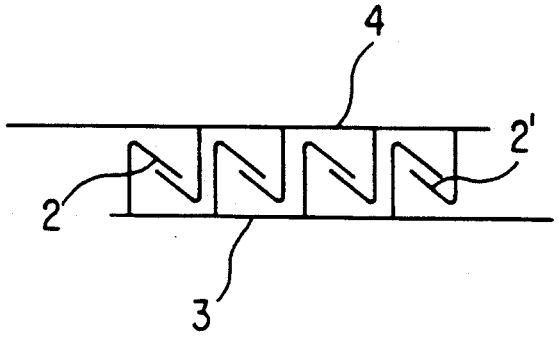
FIG. 15 is a diagrammatic perspective view showing an engaging system utilizing the single-sleeve type molded separable fastener of the present invention.
Figure 16:
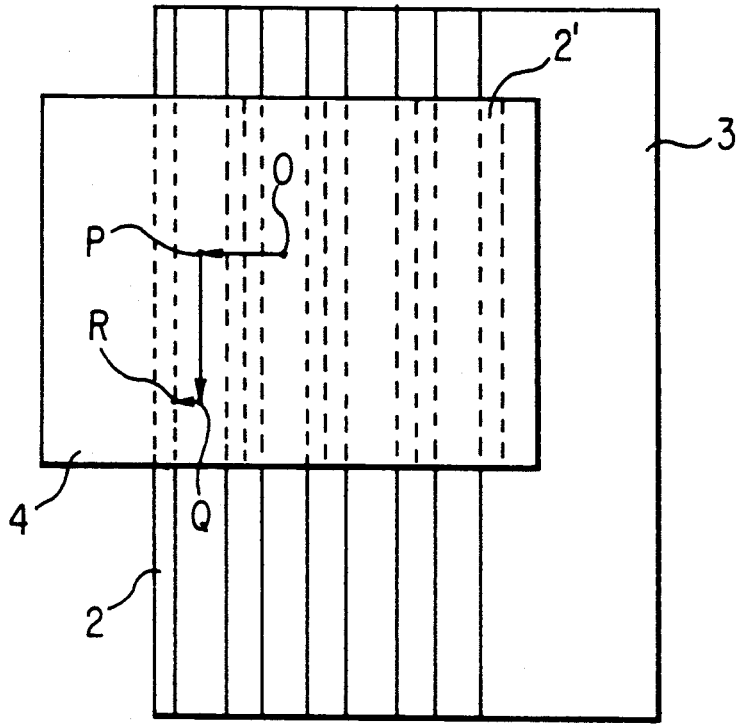
FIG. 16 is a diagrammatic plan view illustrating the position-adjusting mechanism of the molded separable fastener of the present invention.

FIG. 15 shows an example of the engaging system utilizing a molded separable fastener provided thereon with a plurality of single-sleeve type fastening elements 2 as shown in FIG. 2. Here the hook-like fastening elements 2 of a first molded separable fastener 3 are engaged with the hook-like fastening elements 2' of a second molded separable fastener and having the same shape as that of the fastening elements 2, thereby integrally engaging the 2 sheets of the molded separable fastener with each other.

Where 2 sheets of the molded separable fasteners of the present invention are engaged with each other, it is possible to adjust the relative position, which is explained by reference to FIG. 16 showing an example with the molded separable fasteners having single-sleeve type fastening elements. The relative transverse position can be adjusted by changing the position of engagement of a first molded separable fastener 3 with a second molded separable fastener 4 for example from point-O to point-P. The relative longitudinal position can be adjusted by sliding the second separable fastener from point-P to point-Q along the length of the fastening elements 2 and 2'. The transverse position can be fine-adjusted by moving the engagement position of the second molded separable fastener from point-Q to point-R while using a play between the fastening elements engaged with each other.

The molded separable fastener having 2-sleeve type fastening elements is suitable for uses where external force is applied in a direction perpendicular to the length of the fastening elements, i.e. in the transverse direction or in a direction perpendicular to the substrate plane. The molded separable fastener of this type has relatively small freedom and improved fixability as compared with the molded separable fastener having single-sleeve type fastening elements, and are hence suitably used for mounting planar materials, e.g. fixing ceiling materials and mounting roofing tiles, flooring materials, wall materials, tiles, artificial turf and similar articles and parts.

The molded separable fastener having single-sleeve type fastening elements is suitable for uses where external force is principally applied in the transverse direction, and used for fixing or connecting covering materials, e.g. waterproof sheets and construction work sheets, fixing the ends of covering material for car seat, mounting curtains and for like purposes.

Figure 17:
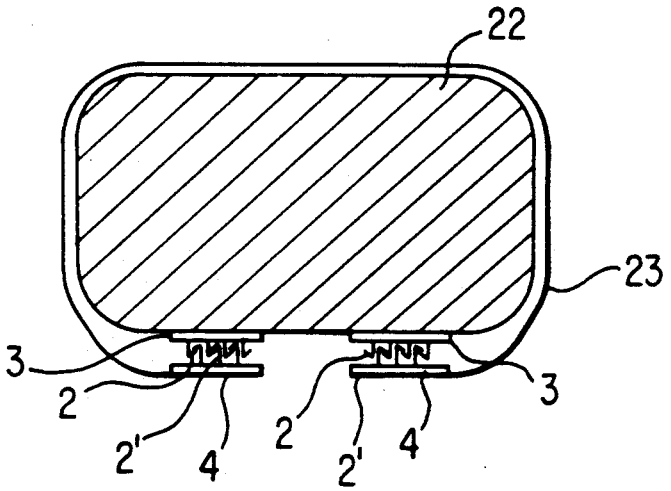
FIG. 17 is a cross-sectional view showing an example where the single-sleeve type molded separable fastener of the present invention is used for mounting a cover material of a car seat.

An example of the above is described with reference to FIG. 17 where a covering material is mounted on car seat or headrest. At first 2 sheets of a first molded separable fastener 3 having single-sleeve type fastening elements 2 are separately fixed on the surface of the bottom of a car sheet 22. Then a covering material 23 provided on each end thereof with a second molded separable fastener of the same type is got ready. The fastening element 2' of the second molded separable fastener 4 fixed on one end of the covering material 23 are engaged with the fastening elements 2 of one of the first molded separable fastener 3 fixed on the surface of the bottom of the car sheet 22. The covering material 23 is then permitted to cover the seat 22 with its other end being pulled over across the seat, and finally the other second molded separable fastener 4 fixed on the other end of the covering material is pressed against the other first molded separable fastener 3 fixed on the surface of the bottom of the car seat 22, thereby engaging with each other the fastening elements 2 and 2' of the first and second molded separable faster 3 and 4, respectively, thus integrally fixing the 2 molded separable fasteners to each other.

In the molded separable fasteners used in the system of the present invention, it is desirable that the top part of a plurality of the fastening elements have a smooth shape. Take for instance the case where the top part of the fastening elements has a circular arc shape. Then, if a second molded separable fastener is applied to a first molded separable fastener in such a direction that their fastening elements are not exactly parallel with each other, the second molded separable fastener will readily slide such that its fastening elements become parallel with those of the first molded separable fastener, whereby the 2 sheets of the molded separable fasteners are readily engaged integrally with each other.

An example of the process for manufacturing the molded separable fastener of the present invention is described with reference to FIG. 18. A resin is melted in an extruder 31 and extruded through a die 32. The extrudates are, while care is being taken not to deform the shape, taken up on a sizing apparatus 33 and then enters, while being cooled, a processing part 34. In the processing part 34, the extrudates move onward while being formed into a shaped article by processing with a cooling means having a plurality of projections that insert into the clearance between adjacent fastening elements and with cooling water, and then being gradually cooled while distortions formed by cooling are removed. The processing temperature varies depending on the resin used. For example polypropylene is cooled once, then heat treated at a temperature of 130° to 140° C. and thereafter gradually cooled to a room temperature. The thus manufactured molded separable fastener is taken up onto a roll 35, cut to the desired lengths with a cutter 36 and then collected into boxes 37, packed and shipped.

Other features of the invention will become apparent in the course of the following description of exemplary embodiments which are given for illustration of the invention and are not intended to be limiting thereof.

EXPERIMENT EXAMPLES 1 THROUGH 5

Figure 18:
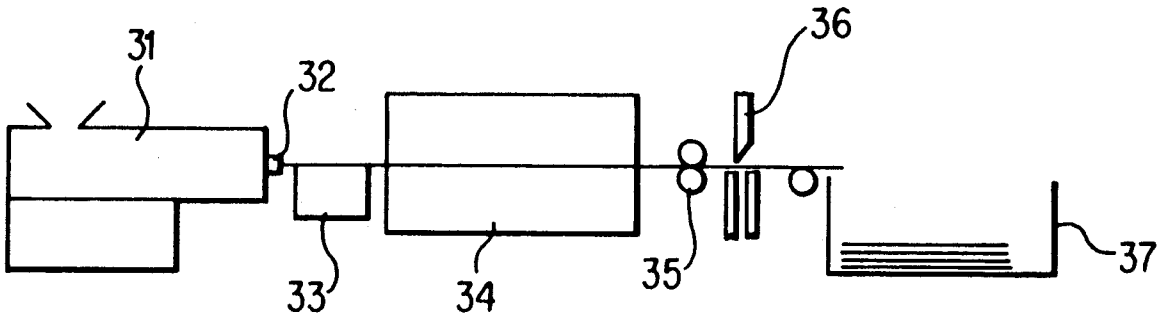
FIG. 18 is a flow chart showing the manufacturing process for the molded separable fastener of the present invention.

A thermoplastic polyvinyl chloride resin having a flexural modulus of 10,000 kg/cm$^2$ is extrusion molded through an apparatus as shown in FIG. 18 into a molded separable fastener provided vertically thereon with a plurality of 2-sleeve type fastening elements having projections on both sides at the top as shown in FIG. 4. The procedure was repeated to obtain 5 types of the molded separable fasteners with different heights (A) of the top of the fastening element from the lowest end of the hook, hook-widths (B), sleeve-end heights (E), engaging depths (D/2) and distances (S) between the outermost ends of 2 adjacent hooks facing each other, as shown in Table 1. All the molded separable fasteners comprised a substrate having a width of 30 mm and a thickness of 1.0 mm provided thereon with 6 lines of fastening elements with a pitch of 4 mm. The molded separable fasteners obtained were cut to lengths of 40 mm, which were tested at a room temperature for the following items.

In any of the molded separable fasteners prepared above, it was possible to, when 2 sheets of the same fasteners are engaged with each other, slide one of the 2 fasteners in the longitudinal direction relative to the other.

(1) Pressing force

When the rear surface of 2 sheets of molded separable fasteners having the same structure and being positioned to face each other is pressed, the minimum pressing force required for engaging with each other the fastening elements of the 2 separable fasteners.

(2) Disengaging strength

The minimum force required for separating apart 2 sheets of molded separable fasteners being integrally engaged with each other.

The results are summarized in Table 1.

The fastening elements of Experiment Example 1 satisfy the afore-mentioned conditions (1) through (3) and have sufficient properties for practical purposes. On the other hand, the fastening elements of Experiment Example 2 do not satisfy condition (1), those of Experiment Examples 3 and 4 do not satisfy condition (2) and those of Experiment Example 5 do not satisfy condition (3), and all of them have problems in practice as shown in Table 1.

TABLE 1

| Experiment Example | A mm | B mm | S mm | E mm | d mm | Pressing force kg/cm$^2$ | Disengaging strength kg/cm$^2$ | Position-adjusting in transverse direction | Overall evaluation |
|---|---|---|---|---|---|---|---|---|---|
| 1 | 1.1 | 2.1 | 1.9 | 1.4 | 1.3 | 1.2 | 7.0 | good | good |
| 2 | 0.4 | 2.1 | 1.9 | 2.1 | 1.3 | 0.9 | 2.5 | too large play | poor |
| 3 | 1.1 | 1.5 | 2.5 | 1.4 | 0.7 | 0 | readily separatable | too large play | poor |
| 4 | 1.1 | 2.5 | 1.5 | 1.4 | 1.6 | difficult to insert | — | — | poor |
| 5 | 1.1 | 2.1 | 1.9 | 1.4 | 0.4 | 9.0 | 10.0 | impossible | poor |

EXPERIMENT EXAMPLES 6 THROUGH 10

A thermoplastic polyvinyl chloride resin having a flexural modulus of 25,000 kg/cm$^2$ is molded into a molded separable fastener provided vertically thereon with a plurality of single-sleeve type fastening elements having a hook-like cross-sectional shape as shown in FIG. 2. The procedure was repeated to obtain 5 types of the molded separable fasteners with different heights (A) of the top of the fastening element from the lowest end of the hook, hook-widths (B), sleeve-end heights (E), engaging depths (D) and distances (S) between the outermost hook end and the back surface at the same height of the adjacent fastening elements, as shown in Table 2. All the molded separable fasteners comprised a substrate having a width of 16 mm and a thickness of 1.1 mm provided thereon with 3 lines of fastening elements with a pitch of 4.9 mm. The molded separable fasteners obtained were cut to lengths of 40 mm, which were tested at a room temperature for the following items.

In any of the molded separable fasteners prepared above, it was possible to, when 2 sheets of the same fasteners are engaged with each other, slide one of the 2 fasteners in the longitudinal direction relative to the other.

(1) Pressing Force

Same as in Experiment Example 1.

(2) Strength of Fastening Elements

When 2 sheets of molded separable fasteners integrally engaged with each other are pulled in the transverse direction, the force required for separating the 2 sheets by deformation of the fastening elements.

The results are shown in Table 2.

The fastening elements of Experiment Example 6 satisfy the afore-mentioned conditions (1) through (3) and have sufficient properties for practical purposes. On the other hand, the fastening elements of Experiment Example 7 do not satisfy condition (1), those of Experiment Examples 8 and 9 do not satisfy condition (2) and those of Experiment Example 10 do not satisfy condition (3), and all of them have problems in practice as shown in Table 2.

Obviously, numerous modifications and variations of the present invention are possible in light of the above teachings. It is therefore to be understood that within the scope of the appended claims, the invention may be practiced otherwise than as specifically described herein.

TABLE 2

| Experiment Example | A mm | B mm | S mm | E mm | D mm | Pressing force kg/cm$^2$ | Strength of fastening elements, kg/cm$^2$ | Position-adjusting in transverse direction | Overall evaluation |
|---|---|---|---|---|---|---|---|---|---|
| 6 | 1.1 | 2.5 | 2.4 | 1.4 | 1.8 | 0.7 | 11 | good | good |
| 7 | 0.4 | 2.5 | 2.4 | 1.4 | 1.0 | 1.5 | 12 | impossible | poor |
| 8 | 1.1 | 2.0 | 2.9 | 1.4 | 1.3 | 0 | readily separatable | too large play | poor |
| 9 | 1.1 | 3.0 | 1.9 | 1.4 | 2.7 | difficult to insert | — | — | poor |
| 10 | 1.1 | 2.5 | 2.4 | 1.4 | 0.6 | 12.0 | 10.0 | impossible | poor |

What is claimed is:

1. A molded-resin separable fastener comprising: a substrate, said substrate being provided vertically on at least one surface of the substrate thereof with a plurality of straight wall-like fastening elements arranged parallel with each other at regular intervals, each of said fastening elements having an umbrella-like cross-sectional shape having a pair of projections extending from the top part towards both sides and downwardly to define a hook; in the cross-sectional shape thereof, the height of the top (Y) of the hook based on the substrate surface line being in a range of 1.5 to 5 mm, the hook width (B) defined by the distance between the outermost ends of said pair of projections being in a range of 1.5 to 5 mm and the relationship between the height (A) of the top of the hook based on a straight line (L) parallel with the substrate surface line and tangent to the lowest end of said projection, the height (E) of said straight line (L) based on the substrate surface line and the distance (D/2) between a point (X) where said straight line (L) crosses a straight line perpendicular thereto and tangent to the outermost end of said projection and a point (V) where said line (L) crosses nearer one of the two lines defining a trunk part, the relationship between said hook width (B) and the distance (S) between the outermost end of the projection and the outermost end of a nearer one of the pair of the projections of an adjacent fastening element and the relationship between the distance (D/2) and the distance between corresponding points on two adjacent ones of said fastening elements, (B+S) satisfying the following conditions:

$$A \leqq E \leqq A + 1.2D \quad (1)$$

$$0.7B \leqq S \leqq 1.2B \quad (2)$$

$$0.15(B+S) \leqq D \leqq 0.45(B+S); \quad (3)$$

wherein said conditions permit a range of a minimum pressing force for engaging two of said fasteners to each other, a range of a minimum disengaging force for separating the engaged fasteners, and permit the engaged fasteners to be freely slidable relative to one another in a longitudinal direction of the fasteners and slightly movable in a direction transverse to said longitudinal direction.

2. A molded-resin separable fastener according to claim 1, wherein the angle ($\beta$) formed by a straight line connecting said point (X) and said point (Y) with the vertical line is 30° to 70°.

3. A molded-resin separable fastener according to claim 1, formed principally of at least one resin selected from the group consisting of polyesters, polyvinyl chloride, polyamides, polyolefins and polyurethanes.

4. A molden-resin separable fastener according to claim 1, formed principally of at least one resin selected from the group consisting of polyesters, polyvinyl chloride, polyamides, polyolefins and polyurethanes.

5. An engaging system utilizing a first molded-resin separable fastener and a second molded-resin separable fastener according to claim 1 and being provided thereon with fastening elements and having the same structure as that of the first molded-resin separable fastener, said system comprising positioning the first and second molded-resin separable fasteners to face each other and then inserting the fastening elements of one of the two molded-resin separable fasteners into clearances provided between adjacent ones of the fastening elements of the other molded-resin separable fasteners to integrally engage with each other the two groups of the fastening elements of the two molded-resin separable fasteners such that the integrally engaged molded-resin separable fasteners are slidable freely relative to the position of each other in the longitudinal direction of the fastening elements and also slightly movable in the transverse direction.

6. A molded-resin separable fastener comprising: a substrate, said substrate being provided vertically on at least one surface of the substrate thereof with a plurality of straight wall-like fastening elements arranged parallel with each other at regular intervals and with a hook-like cross-sectional shape in which a trunk part projects upwardly from the substrate line, curves aslant as it nears the top and bends at the top downwardly, said plurality of straight wall-like fastening elements all being bent at the top downwardly in the same direction; in the cross-sectional shape thereof, the height of the top (Y) of the hook based on the substrate surface line being in a range of 1.5 to 5 mm, the hook width (B) defined by the distance between a point (X) where a straight line (L) crosses a straight line perpendicular thereto and tangent to the outermost end of said bend-down end and a point (Z) where said straight line (L) crosses a farther one of the two trunk-defining lines being in a range of 1.5 to 5 mm and the relationship between the height (A) of the top (Y) of the hook based on said straight line (L), the height (E) of said straight line (L) based on the substrate surface line and the distance (D) between said point (X) and a point (V) where said straight line (L) crosses a nearer one of the two lines defining the upwardly projecting trunk part of said fastening element, the relationship between said hook width (B) and the distance (S) between the outermost end of the bent-down end and said point (Z) of an adjacent fastening element and the relationship between the distance (D) and the distance between corresponding points on two adjacent ones of said fastening elements, (B+S) satisfying the following conditions (1) through (3):

$$A \leqq E \leqq A + 1.2D \quad (1)$$

$$0.7B \leqq S \leqq 1.2B \quad (2)$$

$$0.15(B+S) \leqq D \leqq 0.45(B+S); \quad (3)$$

wherein said conditions permit a range of a minimum pressing force for engaging two of said fasteners to each other, a range of a minimum disengaging force for separating the engaged fasteners, and permit the engaged fasteners to be freely slidable relative to one another in a longitudinal direction of the fasteners and slightly movable in a direction transverse to said longitudinal direction.

7. A molded-resin separable fastener according to claim 6, wherein the angle ($\beta$) formed by a straight line connecting said point (X) and a point where a horizontal line tangent to the top crosses a vertical line passing said point (Z) with the vertical line is 40° to 80°.

8. An engaging system utilizing a first molded-resin separable fastener and a second molded-resin separable fastener according to claim 4 and being provided thereon with fastening elements and having the same structure as that of the first molded-resin separable fastener, said system comprising positioning the first and second molded-resin separable fasteners to face each other such that their hook-like fastening elements are engageable with each other and then inserting the fastening elements of one of the two molded-resin separable fasteners into clearances provided between adjacent ones of the fastening elements of the other molded-resin separable fastener to integrally engage with each other the two groups of the hook-like fastening elements of the two molded-resin separable fasteners such that the thus integrally engaged molded-resin separable fasteners are slidable freely relative to the position of each other in the longitudinal direction of the fastening elements and also slightly movable in the transverse direction.

* * * * *